US007436360B2

(12) United States Patent
Chen et al.

(10) Patent No.: US 7,436,360 B2
(45) Date of Patent: Oct. 14, 2008

(54) ULTRA-WIDE BAND MONOPOLE ANTENNA

(75) Inventors: Li Chen, Melbourne, FL (US); Paul A. Tornatta, Jr., Melbourne, FL (US); Frank M. Caimi, Vero Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 27 days.

(21) Appl. No.: 11/157,154

(22) Filed: Jun. 20, 2005

(65) Prior Publication Data

US 2006/0017620 A1 Jan. 26, 2006

Related U.S. Application Data

(63) Continuation-in-part of application No. 10/418,947, filed on Apr. 18, 2003, now Pat. No. 6,917,334.

(60) Provisional application No. 60/373,865, filed on Apr. 19, 2002.

(51) Int. Cl.
*H01Q 1/38* (2006.01)

(52) U.S. Cl. ..... 343/700 MS; 343/846

(58) Field of Classification Search ..... 343/700 MS, 343/829, 846, 895, 702, 795
See application file for complete search history.

(56) References Cited

U.S. PATENT DOCUMENTS 4,291,311 A * 9/1981 Kaloi ..... 343/700 MS
4,736,454 A * 4/1988 Hirsch ..... 455/129
4,827,266 A * 5/1989 Sato et al. ..... 343/700 MS
4,860,019 A * 8/1989 Jiang et al. ..... 343/795
5,497,164 A 3/1996 Croq
5,680,144 A 10/1997 Sanad
5,757,333 A 5/1998 Kitchener
5,790,080 A 8/1998 Apostolos
5,926,137 A 7/1999 Nealy
6,057,802 A 5/2000 Nealy et al.
6,320,544 B1 11/2001 Korisch et al.
6,323,814 B1 11/2001 Apostolos
6,917,334 B2 7/2005 Chen

OTHER PUBLICATIONS

Harvey, A. F.; "Periodic and Guding Structures at Microwave Frequencies"; IRE Transactions on Microwave Theory Techniques; Jan. 1960; pp. 30-61.

* cited by examiner

*Primary Examiner*—Michael C Wimer
(74) *Attorney, Agent, or Firm*—John L. DeAngelis; Beusse Wolter Sanks Mora & Maire, P.A.

(57) ABSTRACT

A wide band antenna. The antenna comprises a radiating element in a corner region of a substrate, spaced apart from a ground plane occupying a substantial portion of a remaining area of the substrate. Series and shunt impedance matching elements are connected to the radiating element to control the antenna operating parameters. The radiating element is connected to a signal feed.

14 Claims, 15 Drawing Sheets

ULTRA-WIDE BAND MONOPOLE ANTENNA

This application is a continuation in part of application Ser. No. 10/418,947, filed on Apr. 18, 2003, now U.S. Pat. No. 6,917,334), which claims the benefit of provisional application number 60/373,865 filed on Apr. 19, 2002 and entitled, Ultra-wide Band Meanderline Fed Monopole Antenna.

FIELD OF THE INVENTION

The present invention relates generally to antennas for transmitting and receiving radio frequency signals, and more specifically to such antennas operating over a wide bandwidth of frequencies or at multiple resonant frequencies.

BACKGROUND OF THE INVENTION

It is generally known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity and the radiation pattern. Generally for an operable antenna, the minimum physical antenna dimension (or the electrically effective minimum dimension) must be on the order of a quarter wavelength (or a multiple thereof) of the operating frequency, which thereby advantageously limits the energy dissipated in resistive losses and maximizes the energy transmitted. Quarter wavelength and half wavelength antennas are the most commonly used.

The burgeoning growth of wireless communications devices and systems has created a substantial need for physically smaller, less obtrusive, and more efficient antennas that are capable of wide bandwidth or multiple frequency-band operation, and/or operation in multiple modes (i.e., selectable radiation patterns or selectable signal polarizations). Smaller packaging of state-of-the-art communications devices may not provide sufficient space for the conventional quarter and half wavelength antenna elements. Thus physically smaller antennas operating in the frequency bands of interest and providing the other desirable antenna operating properties (input impedance, radiation pattern, signal polarizations, etc.) are especially sought after.

As is known to those skilled in the art, there is a direct relationship between physical antenna size and antenna gain, at least with respect to a single-element antenna, according to the relationship: gain=(βR)^2+2βR, where R is the radius of the sphere containing the antenna and β is the propagation factor. Increased gain thus requires a physically larger antenna, while communications device manufacturers and users continue to demand physically smaller antennas. As a further constraint, to simplify the system design and strive for minimum cost, equipment designers and system operators prefer to utilize antennas capable of efficient multi-frequency and/or wide bandwidth operation, allowing the communications device to access various wireless services operating within different frequency bands from a single antenna. Finally, gain is limited by the known relationship between the antenna frequency and the effective antenna length (expressed in wavelengths). That is, the antenna gain is constant for all quarter wavelength antennas of a specific geometry i.e., at that operating frequency where the effective antenna length is a quarter wavelength of the operating frequency.

The known Chu-Harrington relationship relates the size and bandwidth of an antenna. Generally, as the size decreases the antenna bandwidth also decreases. But to the contrary, as the capabilities of handset communications devices expand to provide for higher data rates and the reception of bandwidth intensive information (e.g., streaming video), the antenna bandwidth must be increased.

One basic antenna commonly used in many applications today is the half-wavelength dipole antenna. The radiation pattern is the familiar omnidirectional donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

The quarter-wavelength monopole antenna placed above a ground plane is derived from a half-wavelength dipole. The physical antenna length is a quarter-wavelength, but with the ground plane the antenna performance resembles that of a half-wavelength dipole. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics. However, conventional loop antennas are too large for handset applications and do not provide multi-band operation. As the loop length increases (i.e., approaching one free-space wavelength), the maximum of the field pattern shifts from the plane of the loop to the axis of the loop. Placing the loop antenna above a ground plane generally increases its directivity.

Given the advantageous performance of quarter and half wavelength antennas, conventional antennas are typically constructed so that the antenna length is on the order of a quarter wavelength of the radiating frequency, and the antenna is operated over a ground plane. These dimensions allow the antenna to be easily excited and operated at or near a resonant frequency, limiting the energy dissipated in resistive losses and maximizing the transmitted energy. But, as the operational frequency increases/decreases, the operational wavelength correspondingly decreases/increases. Since the antenna is designed to present a dimension that is a quarter or half wavelength at the operational frequency, when the operational frequency changes, the antenna is no longer operating at a resonant condition and antenna performance deteriorates.

As can be inferred from the above discussion of various antenna designs, each exhibits known advantages and disadvantages. The dipole antenna has a reasonably wide bandwidth and a relatively high antenna efficiency (or gain). The major drawback of the dipole, when considered for use in personal wireless communications devices, is its size. At an operational frequency of 900 MHz, the half-wave dipole comprises a linear radiator of about six inches in length. Clearly it is difficult to locate such an antenna in the small space envelope associated with today's handheld devices. By comparison, the patch antenna or the loop antenna over a ground plane present a lower profile resonant device than the dipole, but as discussed above, operate over a narrower bandwidth with a highly directional radiation pattern.

As discussed above, multi-band or wide bandwidth antenna operation is especially desirable for use with various personal or handheld communications devices. One approach to producing an antenna having multi-band capability is to design a single structure (such as a loop antenna) and rely upon the higher-order resonant frequencies of the loop structure to obtain a radiation capability in a higher frequency band. Another method employed to obtain multi-band performance uses two separate antennas, placed in proximity, with coupled inputs or feeds according to methods well known in the art. Thus each of the two separate antennas resonates at a predictable frequency to provide operation in at least two frequency bands. Notwithstanding these techniques, it remains difficult to realize an efficient antenna or antenna system that satisfies the multi-band/wide bandwidth operational features in a relatively small physical volume.

In an effort to overcome some of the disadvantages associated with the use of monopole, dipole, loop and patch antennas as discussed above, antenna designers have turned to the use of so-called slow wave structures where the antenna physical dimensions are not equal to its effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one in which the phase velocity of the traveling wave is less than the free space velocity of light. The wave velocity is the product of the wavelength and the frequency and takes into account the material permittivity and permeability, i.e., $c/((\mathrm{sqrt}(\epsilon_r)\mathrm{sqrt}(\mu_r))=\lambda f$. Since the frequency remains unchanged during propagation through a slow wave structure, if the wave travels slower (i.e., the phase velocity is lower) than the speed of light in a vacuum, the wavelength within the structure is lower than the free space wavelength. Thus, for example, a half wavelength slow wave structure is shorter than a half wavelength conventional structure where the wave propagates at the speed of light (c). The slow-wave structure de-couples the conventional relationship between physical length, resonant frequency and wavelength. Slow wave structures can be used as associated antenna elements (i.e., feeds) or as antenna radiating structures.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating the slow wave will be physically smaller than the structure propagating the wave at the speed of light.

Slow wave structures are discussed extensively by A. F. Harvey in his paper entitled *Periodic and Guiding Structures at Microwave Frequencies , in the IRE Transactions on Microwave Theory and Techniques, January* 1960, pp. 30-61 and in the book entitled *Electromagnetic Slow Wave Systems* by R. M. Bodensee published by John Wiley and Sons, copyright 1964. Both of these references are incorporated by reference herein.

A transmission line or conductive surface overlying a dielectric substrate exhibits slow-wave characteristics, such that the effective electrical length of the slow-wave structure is greater than its actual physical length, according to the equation, $$l_e=(\epsilon_{eff}^{1/2})\times l_p$$

where $l_e$ is the effective electrical length, $l_p$ is the actual physical length, and $\epsilon_{eff}$ is the dielectric constant ($\epsilon_r$) of the dielectric material proximate the transmission line.

A prior art meanderline, which is one example of a slow wave structure, comprises a conductive pattern (i.e., a traveling wave structure) over a dielectric substrate, overlying a conductive ground plane. An antenna employing a meanderline structure, referred to as a meanderline-loaded antenna or a variable impedance transmission line (VITL) antenna, is disclosed in U.S. Pat. No. 5,790,080. The antenna consists of two vertical spaced apart conductors and a horizontal conductor disposed therebetween, with a gap separating each vertical conductor from the horizontal conductor.

The antenna further comprises one or more meanderline variable impedance transmission lines bridging the gap between the vertical conductor and each horizontal conductor. Each meanderline coupler is a slow wave transmission line structure carrying a traveling wave at a velocity lower than the free space velocity. Thus the effective electrical length of the slow wave structure is greater than its actual physical length. Consequently, smaller antenna elements can be employed to form an antenna having, for example, quarter-wavelength properties. As for all antenna structures, the antenna resonant condition is determined by the electrical length of the meanderlines plus the electrical length of the radiating elements.

The meanderline-loaded antenna allows the physical antenna dimensions to be reduced, while maintaining an effective electrical length that, in one embodiment, is a quarter wavelength multiple. The meanderline-loaded antennas operate near the known Chu-Harrington limits, that is, efficiency=FVQ, where:

Q=quality factor

V=volume of the structure in cubic wavelengths

F=geometric form factor (F=64 for a cube or a sphere)

Meanderline-loaded antennas achieve this efficiency limit of the Chu-Harrington relation while allowing the effective antenna length to be less than a quarter wavelength at the resonant frequency. Dimension reductions of 10 to 1 can be achieved when compared to a quarter wavelength monopole antenna, while achieving a comparable gain.

BRIEF SUMMARY OF THE INVENTION

According to one embodiment, the present invention comprises an antenna disposed on a printed circuit board. The antenna comprises a radiating element comprising conductive material disposed proximate a corner of the printed circuit board, a ground plane disposed on the printed circuit board and spaced apart from the radiating element, a feed terminal and an impedance matching element operative with the radiating element.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
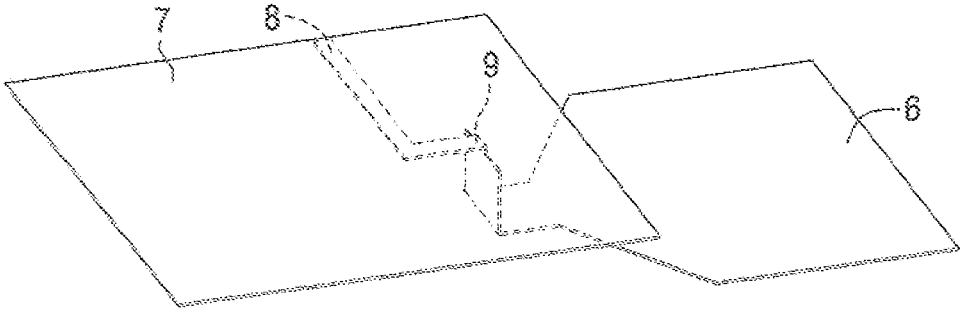
FIG. 1 PRIOR ART
FIG. 1 illustrates a prior art monopole antenna disposed a ground plane.

Before describing in detail the particular ultra wideband antenna in accordance with the present invention, it should be observed that the present invention resides primarily in a novel combination of elements. Accordingly, the elements have been represented by conventional elements in the drawings, showing only those specific details that are pertinent to the present invention, so as not to obscure the disclosure with structural details that will be readily apparent to those skilled in the art having the benefit of the description herein.

FIG. 1 illustrates a prior art monopole antenna 6 electrically connected to an disposed overlying a ground plane 7, with a feed conductor 8 connected to a source feed terminal 9 of the antenna 6. The antenna 6 operates as a conventional monopole antenna above a ground plane as described above.

Figure 2:
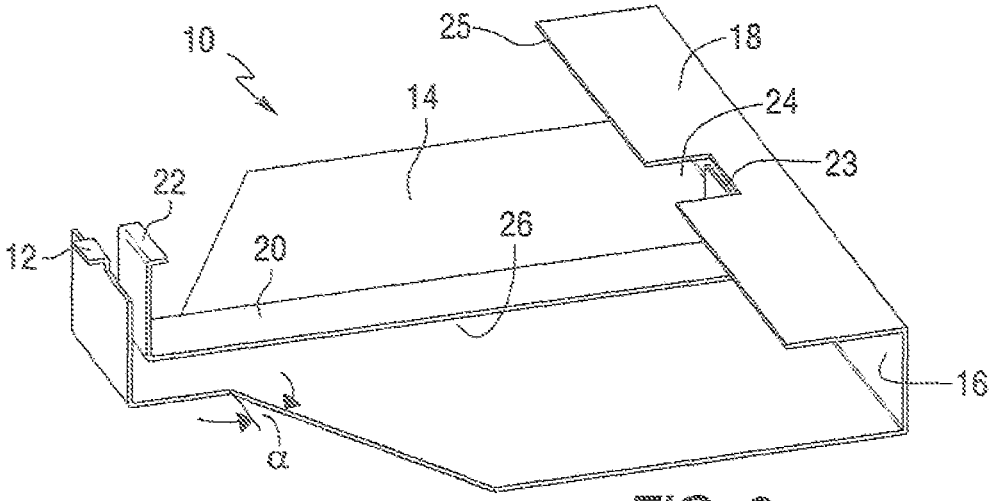
FIGS. 2 through 4 illustrate various views of an antenna constructed according to the teachings of the present invention.
Figure 3:
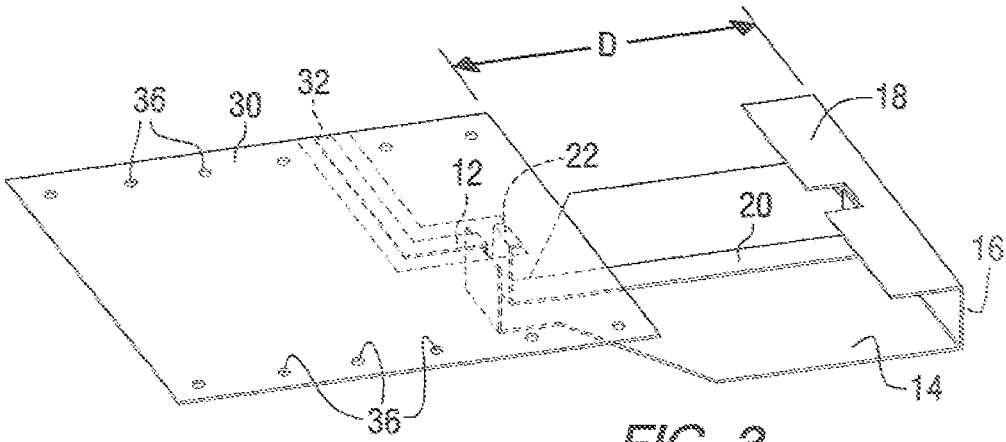

An antenna constructed according to the teachings of the present invention includes the aforementioned meanderline structures and a plurality of radiating elements, forming an antenna with ultra-wide bandwidth characteristics. One embodiment of such an antenna 10 constructed according to the teachings of the present invention is illustrated in FIGS. 2 and 3. FIG. 2, which is a perspective bottom view, illustrates the arrangement and serial interconnections of a source terminal 12, a top radiator 14, a side radiator 16, a bottom radiator 18, a meanderline 20 (i.e., a slow wave structure) and a ground terminal 22. The top radiator 14 operates as a monopole antenna above a ground plane, with the side radiator 16 and the bottom radiator 18 providing additional radiating surfaces at certain frequencies.

The meanderline 20 is connected to the bottom radiator 18 along an edge 23 of a notch 24 formed in the bottom radiator 18. Use of the notch 24 allows increased physical length for the meanderline 20, thus increasing the antenna electrical length and the antenna bandwidth. In an embodiment operating over a narrower bandwidth, the additional physical length provided by the notch 24 may not be required. Instead, in such an embodiment the meanderline 20 is connected to an edge 25 of the bottom radiator 18.

In the embodiment of FIG. 2, an air gap 26 formed between the meanderline 20 and the top radiator 14 serves as the dielectric medium for the meanderline 20. In another embodiment the gap is filled with a dielectric material other than air to impart different slow wave characteristics to the signal carried over the meanderline 20, and thus different characteristics to the antenna 10.

The antenna 10 and an accompanying ground plane 30 are illustrated in the bottom view of FIG. 3. As shown, a signal feed 32 connected to the source terminal 12, is disposed on the hidden surface of the ground plane 30 for providing a signal to associated receiving equipment (not shown) when the antenna 10 is operative in the receiving mode, and for providing a signal from associated transmitting equipment (not shown) for transmission when the antenna 10 is operative in the transmitting mode. The signal feed 32 can terminate in a suitable coupling termination (not shown) for connection to the associated receiving and transmitting equipment.

As shown in FIG. 3, the ground terminal 22 is connected to the ground plane 30. In one embodiment the ground plane 30 is formed from conductive material disposed on opposing surfaces of a dielectric substrate. For example, the substrate comprises conventional printed circuit board material having a dielectric core and a conductive material layer on opposing core surfaces. The conductive material layer on the two surfaces is electrically connected by one or more conductive vias 36, forming the ground plane 30.

In a preferred embodiment the side radiator 16 is perpendicular to both the top radiator 14 and the bottom radiator 18. In this embodiment, the source terminal 12 and the ground terminal 22 are substantially co-planar with the bottom radiator 18. Thus the width of the side radiator 16 effectively determines the distance between the top radiator 14 and the ground plane 30.

In one embodiment, the antenna 10 is constructed from plantar conductive sheet material that is formed into a final shape substantially as described herein. The structure is relatively simple, easily manufactured using known metal stamping and bending processes, and thus offers a low cost wide bandwidth antenna solution for communications devices operative over a wide frequency band or operative on several adjacent frequency bands.

It has been determined that the total antenna length (that is, the sum of the effective electrical length of the top radiator 14, the side radiator 16, the bottom radiator 18 and the meanderline 20) is about one-seventh of a wavelength at the lowest resonant frequency. However, this wavelength/frequency does not necessarily define the lower edge of the operative frequency band.

The meanderline 20 operates as a tuning element for the antenna 10 such that the effective electrical length of the meanderline 20, operating as a slow wave structure, affects the antenna operating bandwidth. The meanderline 20 emits and receives little energy.

The length of the bottom radiator 18 has been shown to primarily affect antenna performance at lower frequencies. As the length is reduced the low frequency performance deteriorates. In a preferred embodiment, the length of the bottom radiator 18 is about 20% to 30% of the top radiator length.

In a preferred embodiment, the angle $\alpha$ in FIG. 2 is about 20°. It has been determined that this angle can be varied to affect performance at higher frequencies. Generally, decreasing the angle improves performance at higher frequencies while limiting performance at lower frequencies. Thus the angle is selected based on the desired frequency performance of the antenna 10.

In one embodiment the antenna height, which has been found to primarily affect performance at the lower frequencies, is about 8 mm. Thus the antenna 10 presents a low profile, suitable for use with handheld communications devices where available space is limited. The input impedance of the antenna 10 is approximately 50 ohms.

The antenna 10 extends the low frequency performance for the same physical dimensions as the prior art monopole antenna operating above a ground plane as shown in FIG. 1. For example, assuming antenna dimensions of about 36 mm by 33 mm by 8 mm disposed over a ground plane of about 54 mm by 85 mm, the edge of the lower resonant band for a conventional prior art monopole antenna is about 1.2 GHz, with a bandwidth of about 1 GHz (i.e., from about 1.2 to about 2.2 GHz). The antenna 10 constructed according to the teachings of the present invention exhibits a lower resonant frequency of about 800 MHz and a bandwidth of about 1.8 GHz, i.e., from 0.8 to 2.6 GHz.

It has been determined that the dimension "D" in FIG. 3 significantly contributes to the low frequency performance of the antenna 10. Increasing the distance "D" lowers the resonant frequencies of the antenna and thus improves the low frequency performance. Decreasing "D" induces coupling between the bottom radiator 18 and the ground plane 30, which degrades the low frequency performance. As can be seen, however, increasing "D" also increases the space occupied by the antenna 10 within a communications device. In one embodiment, the distance "D" is about 25 mm and the low frequency performance extends to about 800 MHz.

Figure 4:
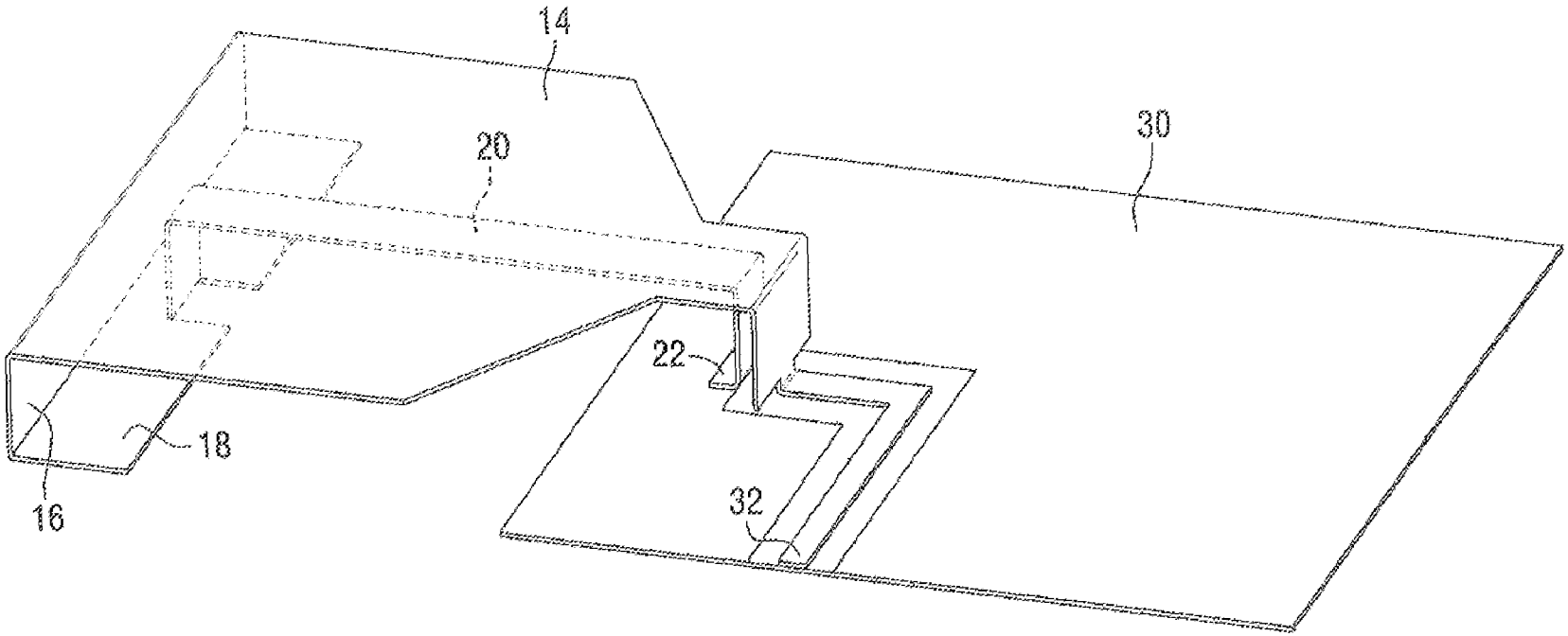

FIG. 4 is a side perspective view of the antenna 10 of the present invention and the ground plane 30. The top radiator 14 is connected to the signal feed line 32 via the source terminal 12, and the meanderline 20 is connected to the ground plane 30 via the ground terminal 22.

Various operational characteristics of the antenna 10 are depicted in FIGS. 5 through 15, including illustrative comparisons of a prior art monopole above a ground plane, as in FIG. 1, and the antenna 10 constructed according to the teachings of the present invention.

Figure 5:
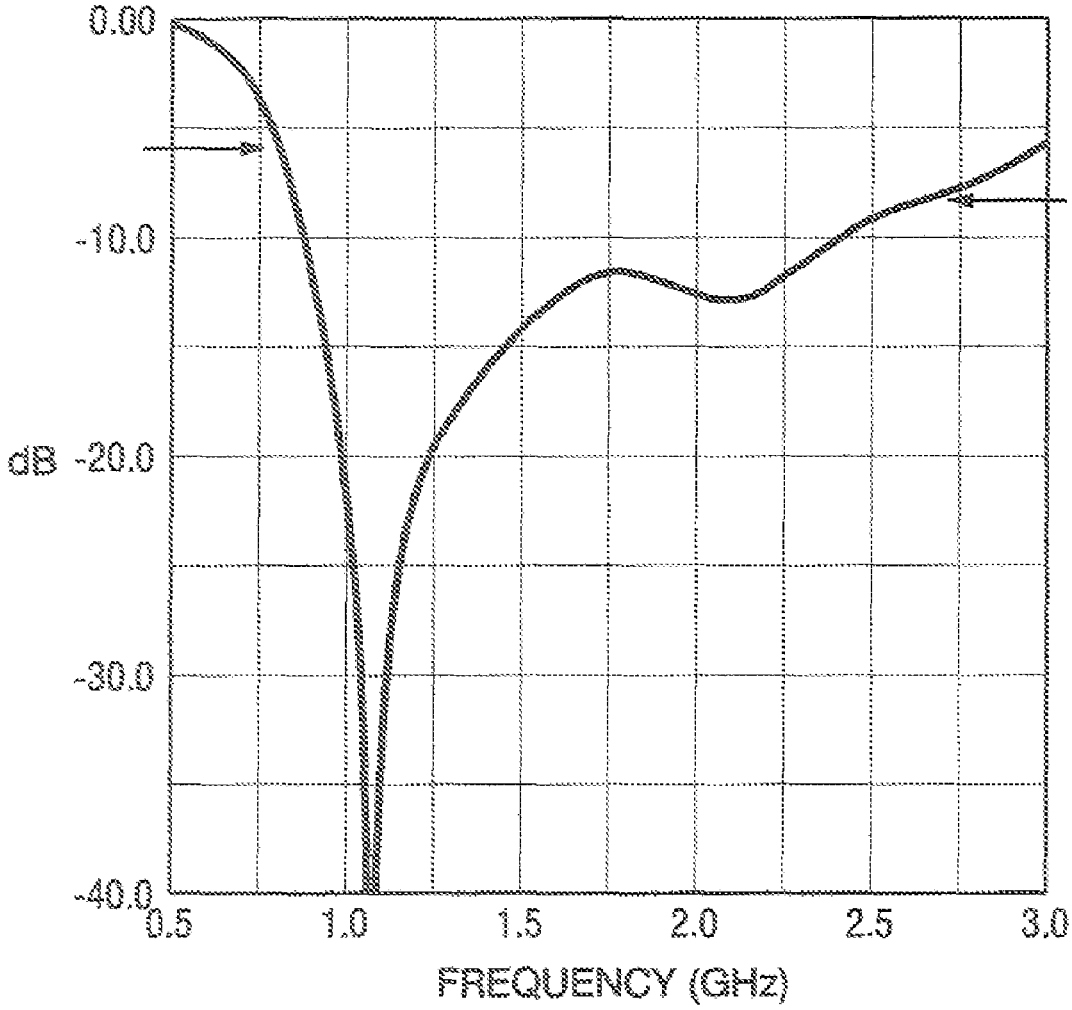
FIGS. 5 through 15 graphically illustrate various performance parameters associated with the antenna constructed according to the teachings of the present invention.

As shown by the return loss plot in FIG. 5, the bandwidth of the ultra-wide bandwidth antenna 10 ranges from about 800 to about 2700 MHz, as defined by the frequency band where the voltage standing wave ratio is less than about 2.5 to 1.

Figure 6:
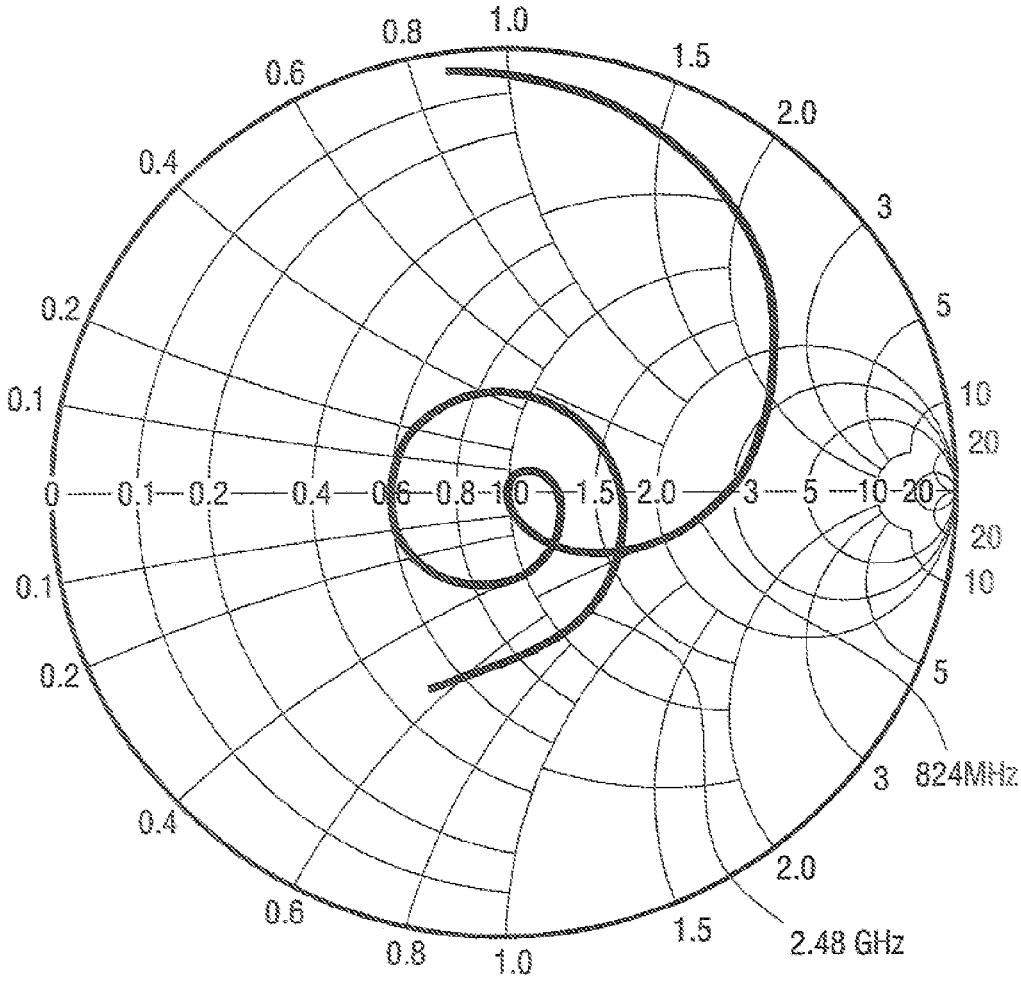

FIG. 6 is a Smith chart illustrating the voltage standing wave ratio of the antenna 10, noting in particular the characteristics at the indicated frequencies of about 824 MHz and 2.48 GHz.

Figure 7:
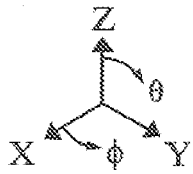
Figure 8:
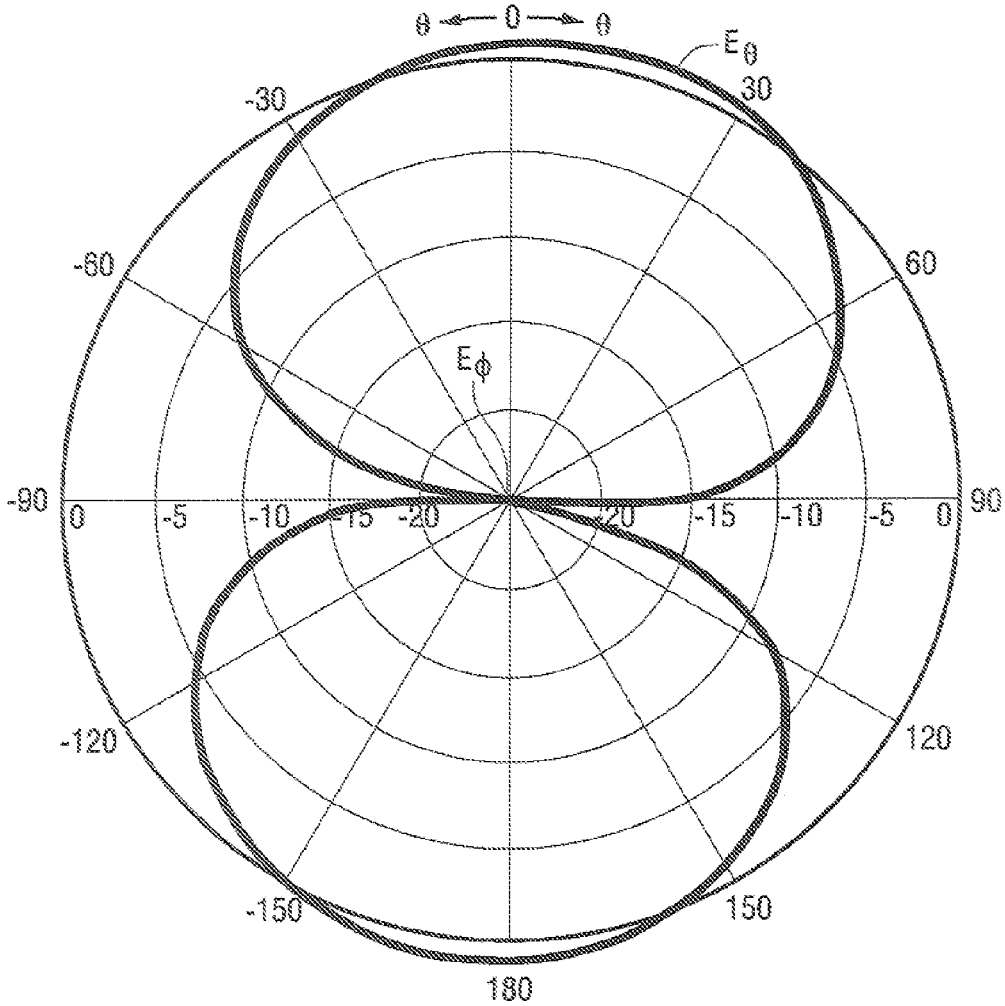
Figure 9:
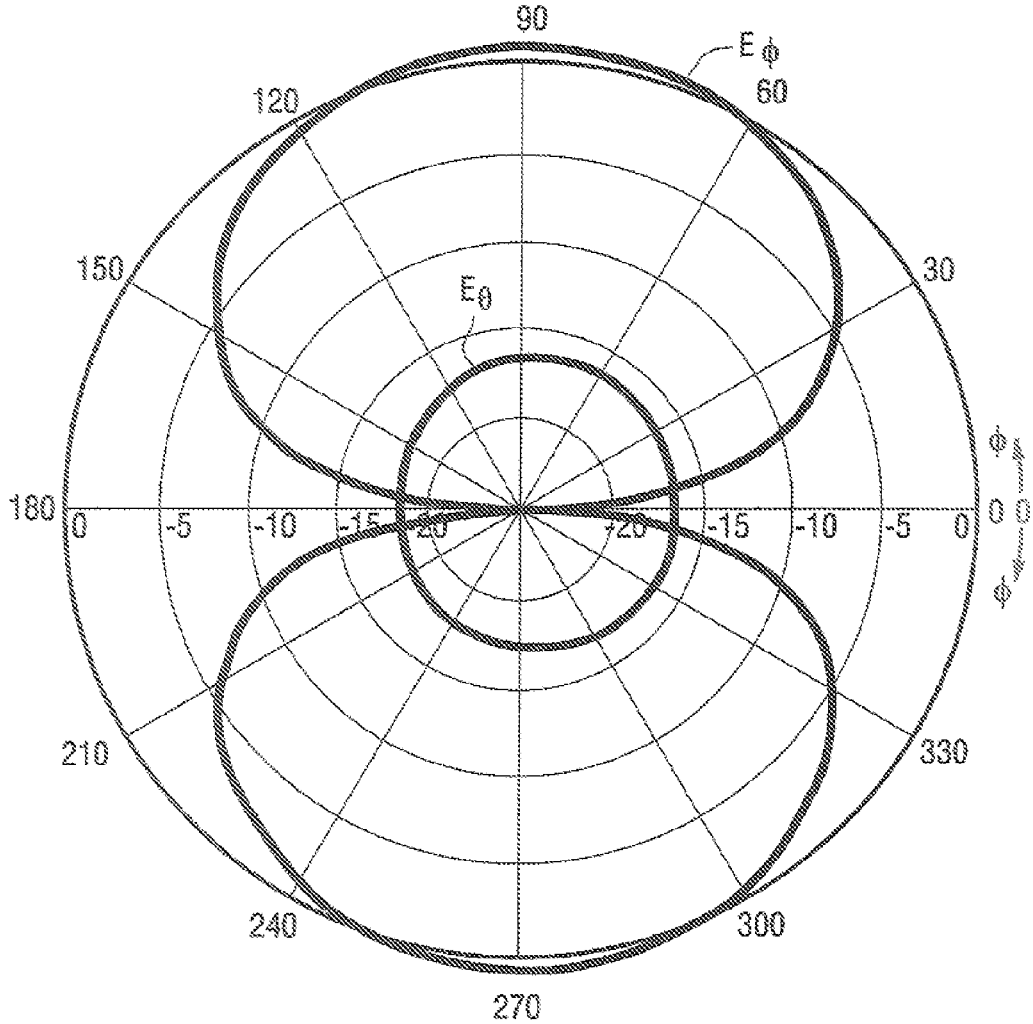

With reference to the coordinate system of FIG. 7, FIGS. 8 and 9 depict, respectively, the radiation patterns (at a frequency of about 850 MHz) in the theta (or y-z) plane with $\theta$ varying between 0 and 360° (FIG. 8), and the radiation pattern in the phi (or x-y) plane with $\Phi$ varying between 0 and 360° (FIG. 9). Both the theta and phi electric field vectors are illustrated in the Figures, i.e., $E_\theta$ and $E_\Phi$. In the various radiation pattern figures presented herein, the antenna 10 is oriented such that the ground plane 30 is parallel to the x-y plane.

Figure 10:
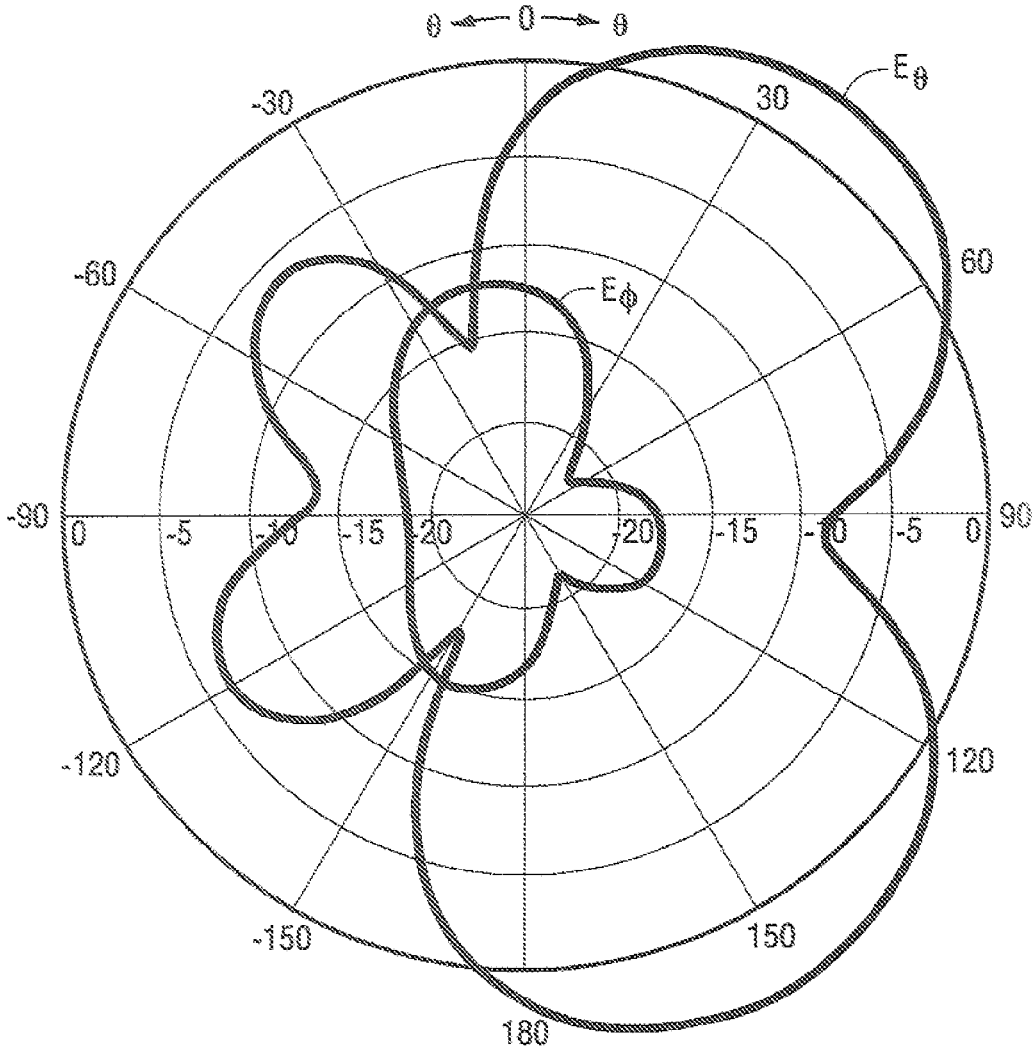
Figure 11:
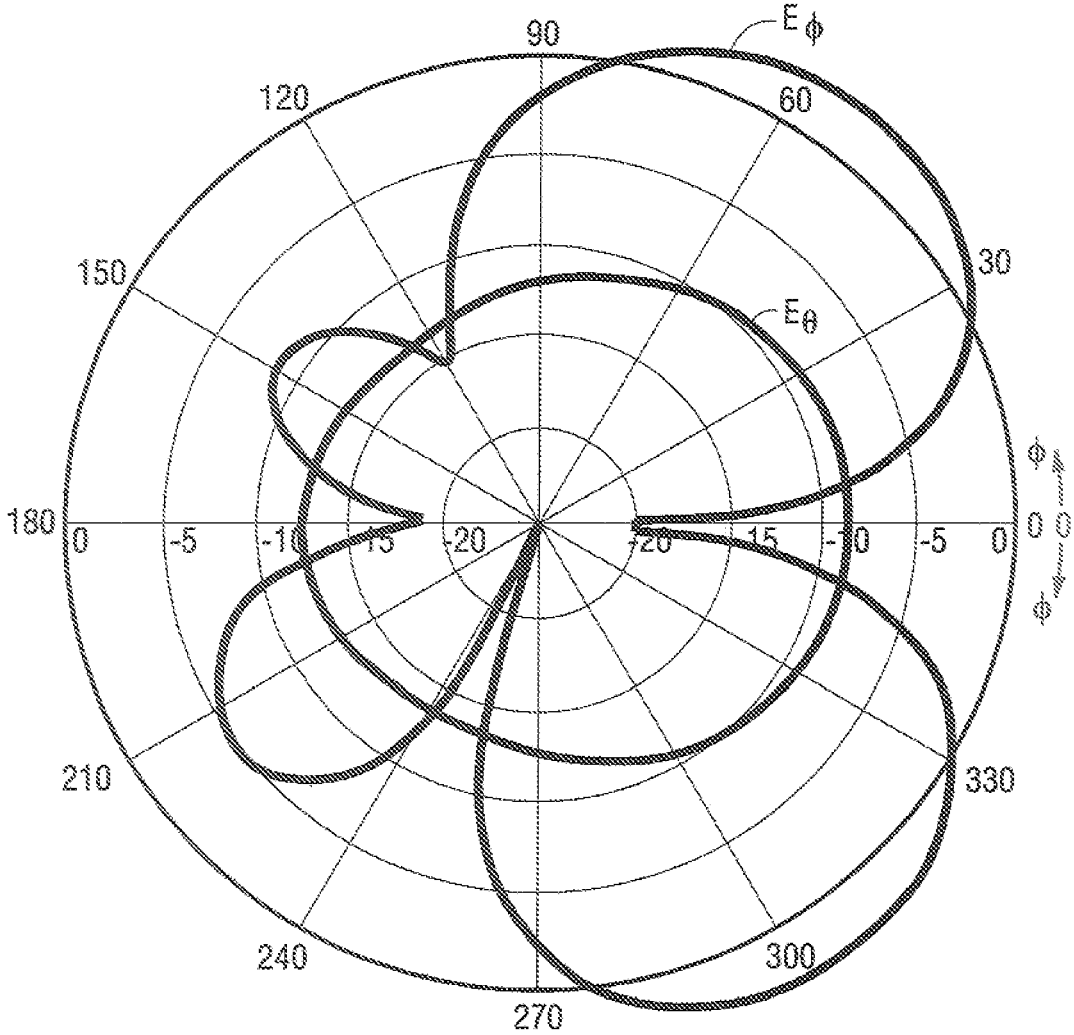

FIGS. 10 and 11 illustrate the same radiation patterns for the electric field vectors as FIGS. 8 and 9, but at a frequency of about 1.92 GHz.

Figure 12:
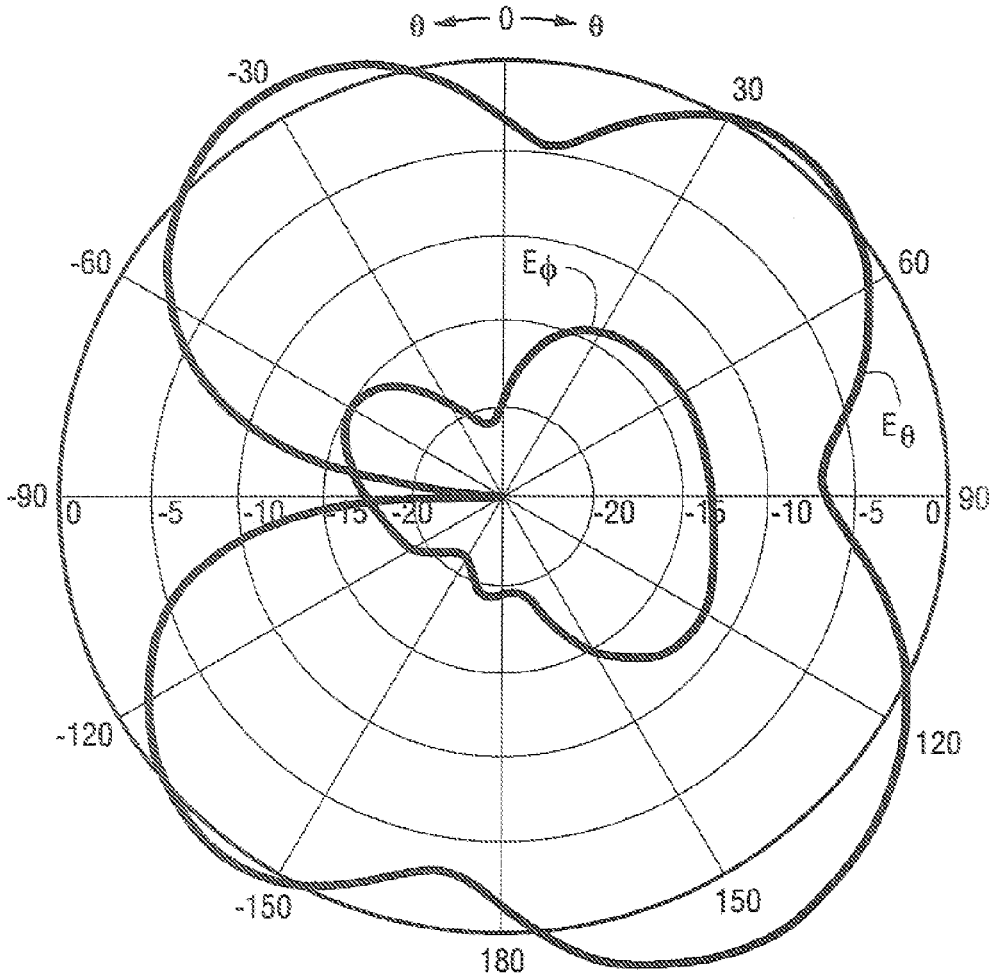
Figure 13:
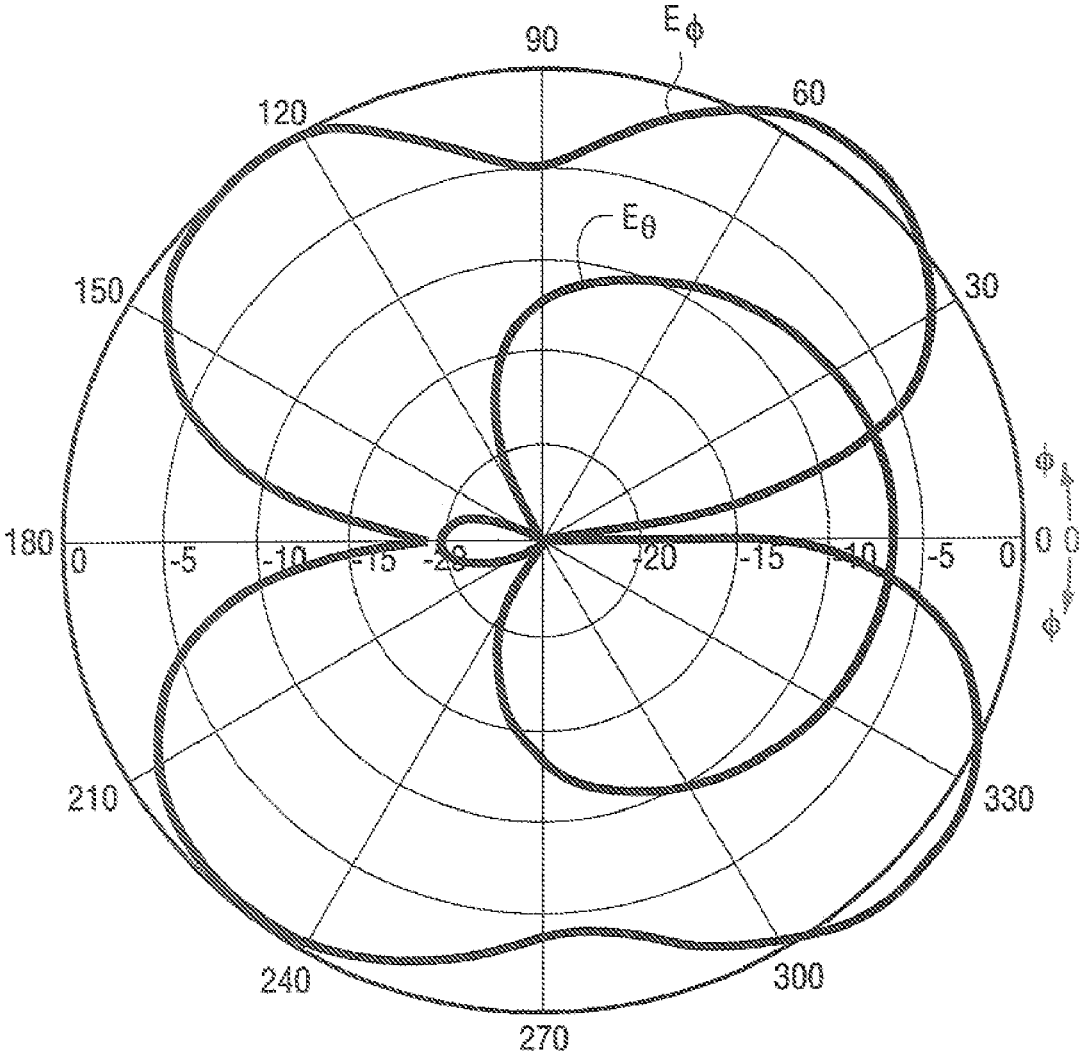

FIGS. 12 and 13 also illustrate the same radiation patterns for the electric field vectors at a frequency of about 2.48 GHz.

Figure 14:
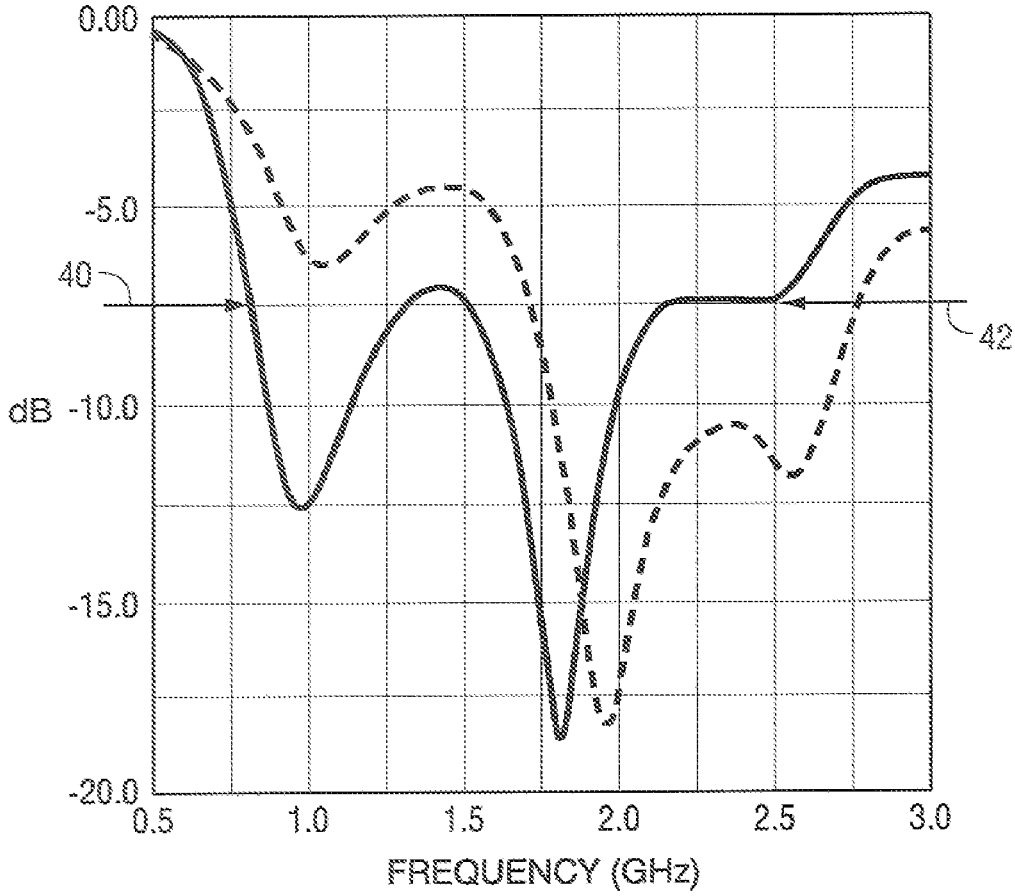

FIG. 14 illustrates the antenna return loss for both an exemplary ultra wideband antenna constructed according to the teachings of the present invention (solid line) and the prior art conventional monopole antenna (dashed line). The approximate bandwidth for the ultra wideband antenna is about 1.7 GHz, as indicated by the arrowheads 40 and 42 at about 800 MHz and 2.5 GHz, respectively. Thus the antenna operates in all of the wireless, cellular and global positioning system frequency bands, at a minimum efficiency of about 75%. In certain bands the efficiency is greater than 90%.

Figure 15:
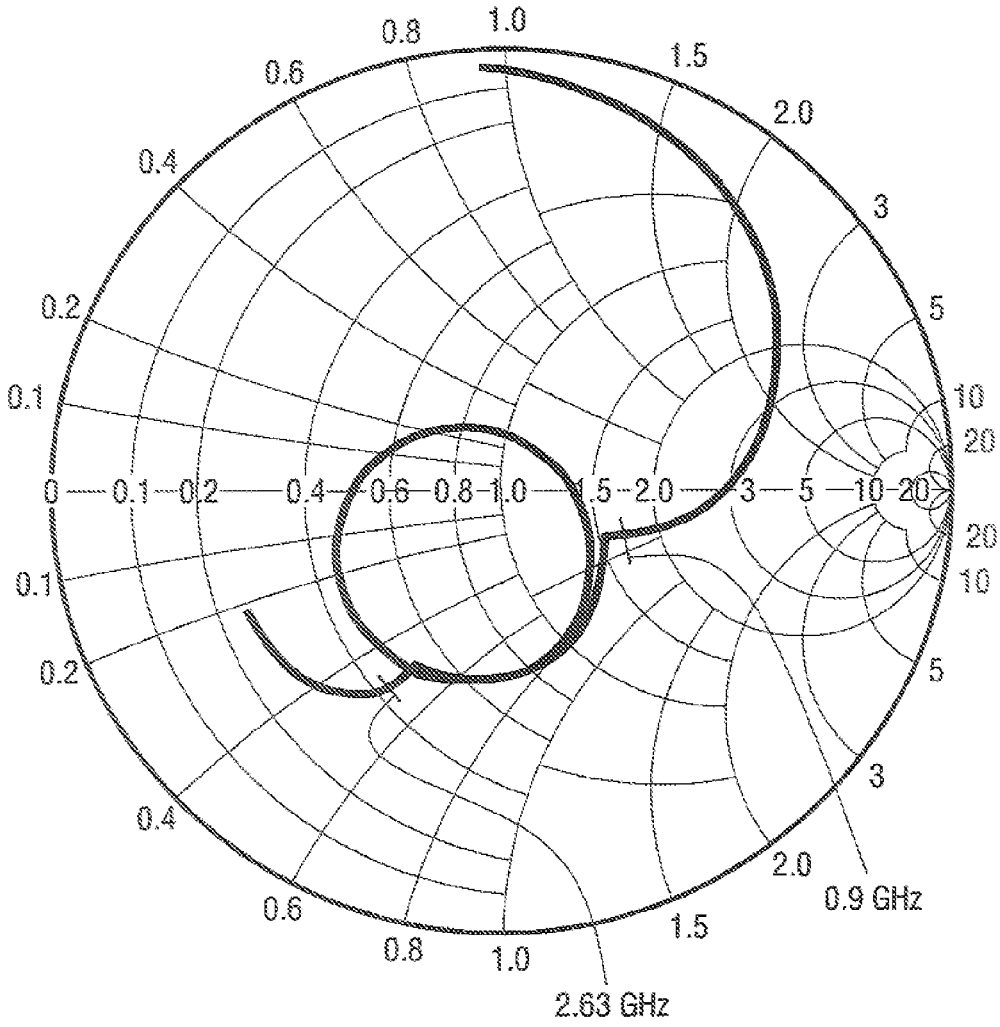

The Smith chart of FIG. 15 depicts the VSWR of an exemplary ultra wideband antenna. Between the approximate frequencies of 0.90 and 2.63 GHz (a bandwidth of 1.73 GHZ) the VSWR is in less than 2:1.

Figure 16:
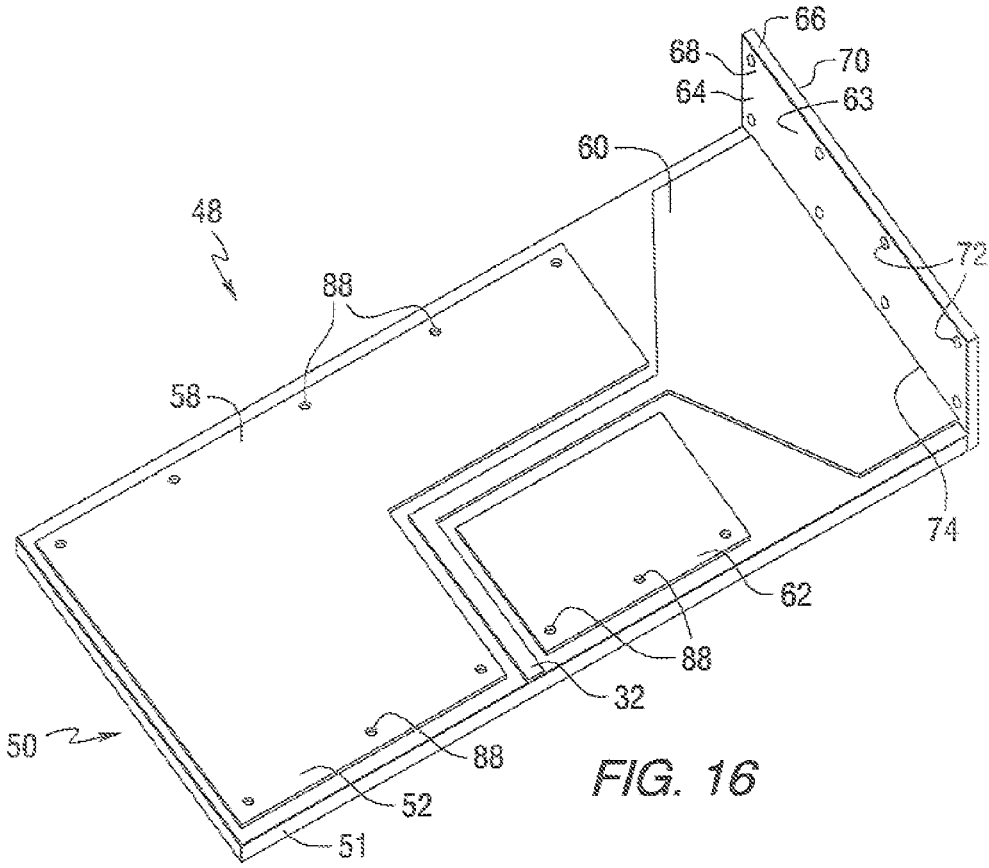
FIGS. 16 and 17 illustrate another embodiment of an antenna constructed according to the teachings of the present invention.
Figure 17:
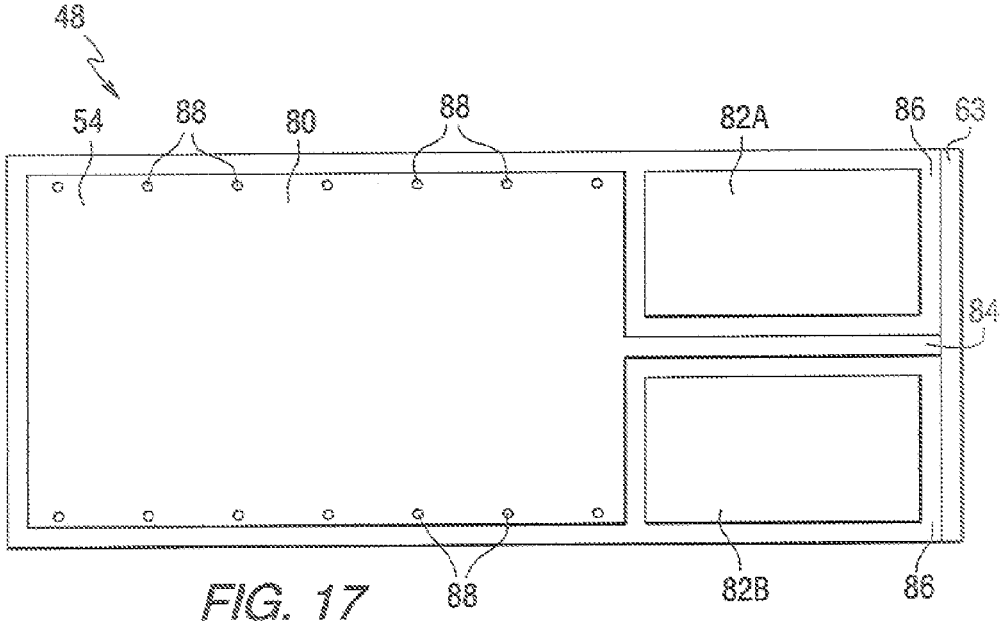

Another embodiment of an ultra wide bandwidth antenna 48 constructed according to the teachings of the present invention is illustrated in FIGS. 16 and 17. The antenna 48 is constructed from printed circuit board materials (e.g., a dielectric core substrate material with conductive material disposed on one or both surfaces thereof) and formed according to printed circuit board patterning technologies. The embodiment of FIGS. 16 and 17 comprises substantially the same antenna elements as the embodiments described above.

In the top view of FIG. 16, a substrate 50 comprises a dielectric core 51 and upper and lower sheet conductors 52 and 54 (see the bottom view of FIG. 17) disposed on opposing surfaces thereof. The upper sheet conductor 52 is patterned and etched, using known processing technologies, to form a top ground plane 58, a top radiator 60 connected to a signal feed 32, and a ground plane segment 62.

A side radiator 63 is formed from an upstanding substrate 64, disposed substantially perpendicular to the substrate 50, comprising a dielectric core 66 and sheet conductors 68 and 70 disposed on opposing surfaces of the core 66, and electrically connected by conductive vias 72. The top radiator 60 is electrically connected to the side radiator 63 along a line 74. In one embodiment, the electrical connection is provided by a solder joint along the line 74.

In the bottom view of FIG. 17, the lower sheet conductor 54 is patterned to form a ground plane 80 and two bottom radiator regions 82A and 82B. A meanderline 84 is electrically connected between the side radiator 63 and the ground plane 80. The ground planes 58, 62 and 80 are interconnected by conductive vias 88.

In a departure from the embodiments described above, in an embodiment of the antenna 48 illustrated in FIGS. 16 and 17, a gap 86 (see FIG. 17) separates the conductive surfaces of the side radiator 63 from the bottom radiator regions 82A and 82B. The gap 86 forms a capacitance that tunes out the inductive reactance of the other antenna elements. The top radiator 60 operates as a broadband monopole above a ground plane, at high frequencies as established by the side radiator 63 and the meanderline 84. At low frequencies the top radiator 60, the side radiator 63 and the meanderline 84 are resonant over a broad band as the meanderline 84 compensates the reactance of the other antenna elements as the frequency varies.

In another embodiment, the gap 86 is omitted and the side radiator 63 is electrically connected to the bottom radiator regions 82A and 82B.

Figure 18:
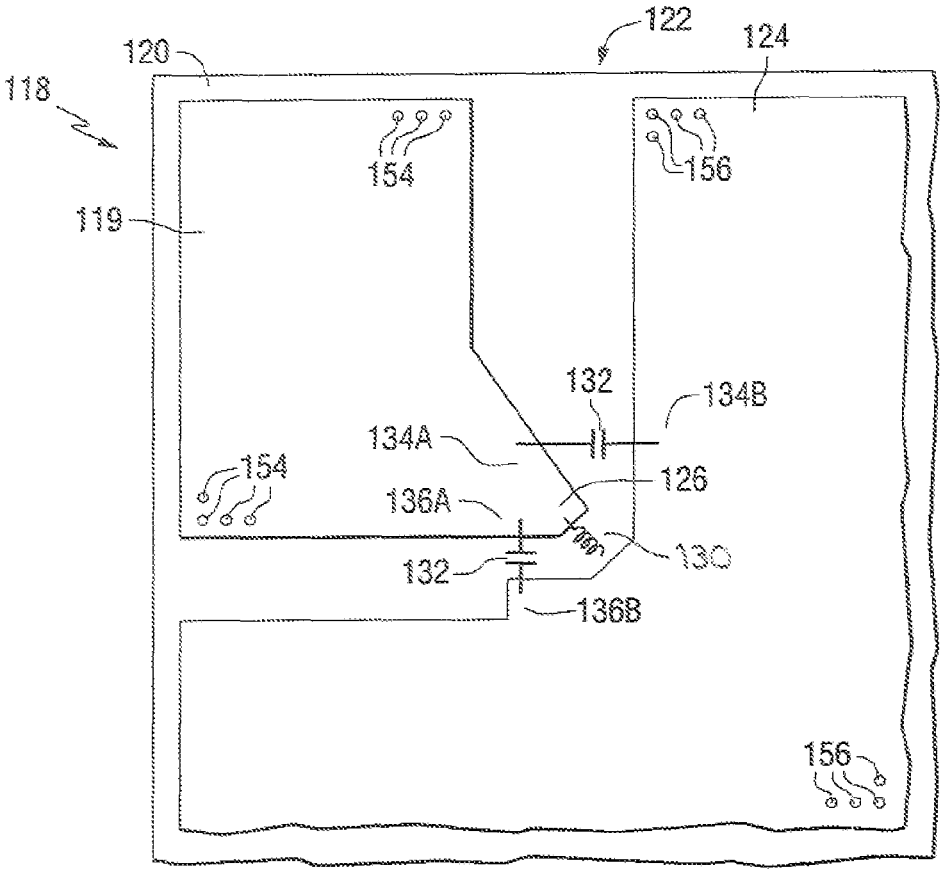
FIGS. 18 and 19 illustrate PCB antennas constructed according to the teachings of other embodiments of the present invention.

Another embodiment of a wide-band antenna 118 constructed according to the teachings of the present invention is illustrated in FIG. 18. According to one implementation, a radiating element 119 of the antenna 118 is disposed in a corner region 120 of a printed circuit board (PCB) 122 that carries electronic components (not shown) and a ground plane 124 of an electronics communications device. The antenna 118 further comprises a feed terminal in electrical communication with the radiating element 119 and insulated from the ground plane 124. FIG. 18 illustrates an exemplary feed element 126.

Although embedded or PCB radiating elements are known in the art, they are significantly affected by proximate structures of the communications device. Typically, the problem is resolved by iterating the antenna design, that is, modifying the antenna structures formed in the PCB until an antenna having desired performance characteristics is realized. Optimum impedance matching is accomplished through selection of the shape and spacing between the radiating element and the ground plane. Matching components are typically not required. These prior art antennas usually radiate over a multi-octave bandwidth.

Problems arise however, in antenna development for mass production for a variety of target communications devices.

Since each communications device comprises a different size PCB populated with different electronic and mechanical components that may affect antenna performance, each device requires a unique antenna design (and each antenna design is assigned a different part number) to optimize device performance at the desired operating frequencies. Designing the antenna for a single communications device may require several design iterations during which the antenna element shapes and dimensions are adjusted to achieve acceptable operation in the target device. Further, this iterative design process must be carried out for each target communications device. To avoid the need for multiple antenna designs and iterating of each design, a single antenna solution is preferred to reduce inventory, multiple production tooling costs and distribution logistics.

The antenna 118 of the present invention eliminates the design iterations to produce an antenna providing acceptable operating parameters. The wide-band radiating element 119 operates with a wide-band matching network comprising, in one embodiment a series inductance 130 (in series with the feed terminal 126) and a shunt capacitance 132 (disposed between regions 134A of the radiating element 119 and 134B on the ground plane 124, and/or between regions 136A of the radiating element 119 and 136B on the ground plane 124). Those skilled in the art recognize the inductance 130 and the capacitance 132 can be connected at other locations of the radiating element antenna 119 and the ground plane 124. Likely values of the inductance 130 and the capacitance 132 are among those commonly used in radio frequency circuits. Preferably, the inductance 130 and the capacitance 132 comprise a chip inductor and a chip capacitor, respectively.

According to the present invention, the inductance and capacitance values are adjusted to mitigate detuning or other performance problems caused by the PCB and the components mounted thereon, the enclosure surrounding the PCB (including the material of the enclosure e.g., different plastic compositions) and other mechanical components and structures proximate the antenna 118. Thus antenna performance characteristics (e.g., return loss or VSWR) can be optimized for a specific operating frequency band and application (e.g., for operation with a specific communications device).

For example, an antenna operative with a wideband local area network should exhibit a low VSWR (<1.8:1). The prior art wideband monopole antennas are not capable of providing the low VSWR over the desired bandwidth. The antenna 118 of the present invention can accommodate the low VSWR requirement (and other performance parameters) by proper selection of the series inductance 130 and the shunt capacitance 132 for the expected operating environment. The antenna is easily modified for use in a different operating environment by simply changing the value of one or more of the impedance matching components.

The antenna 118 provides acceptable impedance matching and radiation efficiency over multiple operating frequencies. One embodiment covers the various communications services operating within frequency bands including 2.4 GHz, 4.9 GHz, 5.25 GHz and 5.85 GHz. Modification of the matching network comprising the series inductance 130 and the shunt capacitance 132 optimizes antenna performance for operation in other frequency bands and operating environments, without requiring modification to the PCB artwork.

Figure 19:
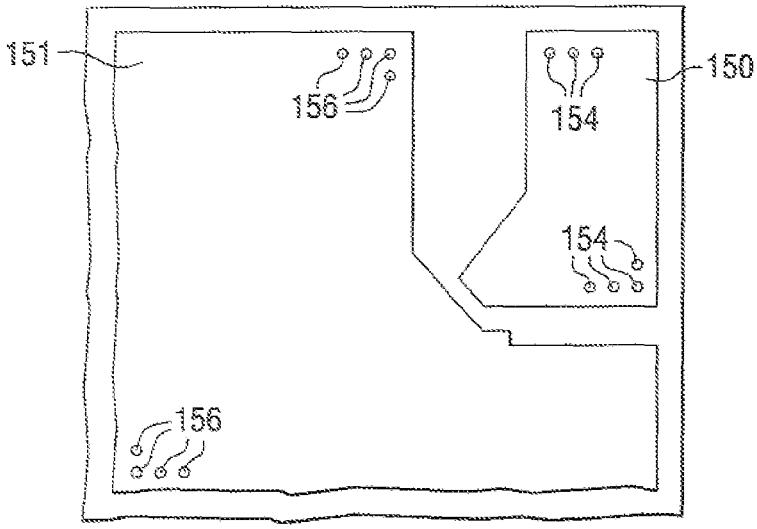
Figure 20:
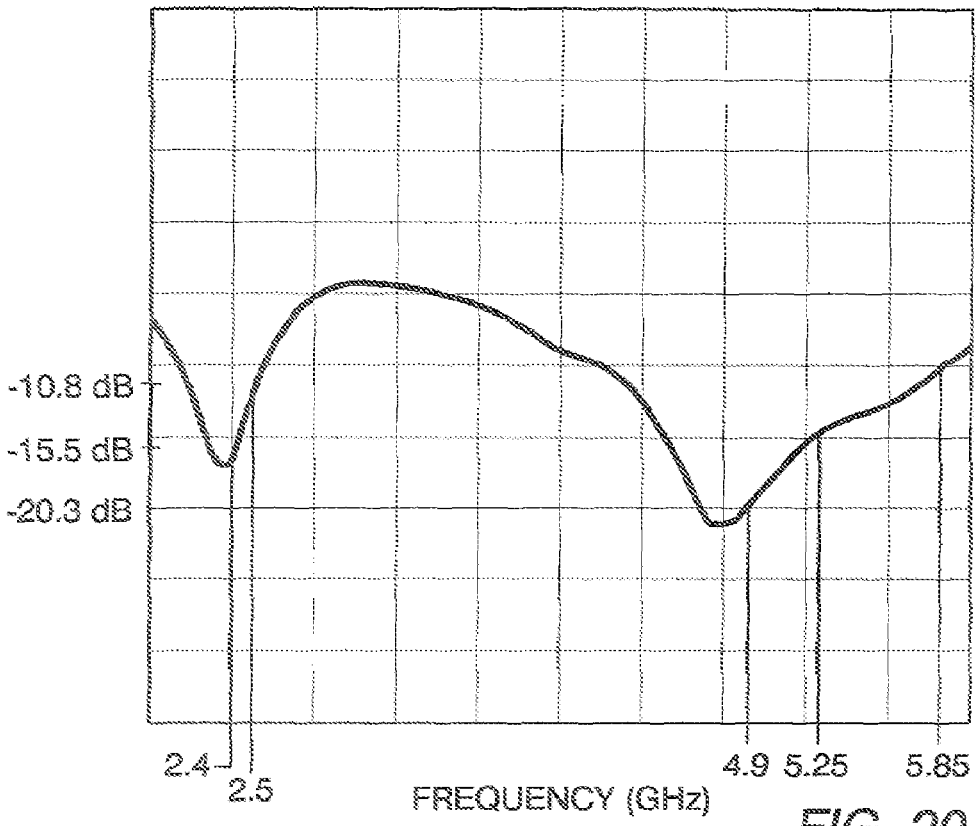
FIG. 20 illustrates a return loss with respect to frequency for the antenna of FIG. 18.

In another embodiment an antenna comprises the radiating element 119 and the ground plane 124 on first surface of the PBC 122 as illustrated in FIG. 18. and a radiating element 150 and a ground plane 151 disposed on an opposing surface of the PCB 122 as illustrated in FIG. 19, wherein the radiating elements 119 ad 150 have substantially the same geometric shape and are symmetrically vertically aligned in parallel planes. A plurality of conductive vias 154 electrically connect the radiating elements 119 and 150, and a plurality of conductive vias 156 electrically connect the ground planes 124 and 151 (only several of the conductive vias 154 and 156 are illustrated to avoid cluttering FIGS. 18 and 19).

An exemplary antenna 118 is about 2600 mils long and about 1600 mils wide. The radiating element 119 (and the ground plane 124) are formed by known subtractive etching processes to remove conductive material from a conductive clad dielectric substrate. Although identified as a ground plane 124 in FIG. 18, the ground plane region may include electronic and mechanical components associated with operation of the communications device in which the antenna 118 is incorporated.

According to another embodiment, the shunt capacitance 132 comprises an electrically controllable capacitor to achieve adaptive dynamic control of the antenna voltage standing wave ratio as presented at the antenna feed terminal 126. This embodiment provides improved performance in wireless local area network applications and other applications where the best possible match between the antenna and power amplifier is required. This embodiment also provides dynamic correction of environmentally induced loading due to the presence of the operator or other objects in the vicinity of the wireless device. Adjustment of the variable capacitor, either automatic self-adjustment by internal control mechanisms know in the art or manually by the user, provides real world, real time control in response to the operating environment.

Figure 21:
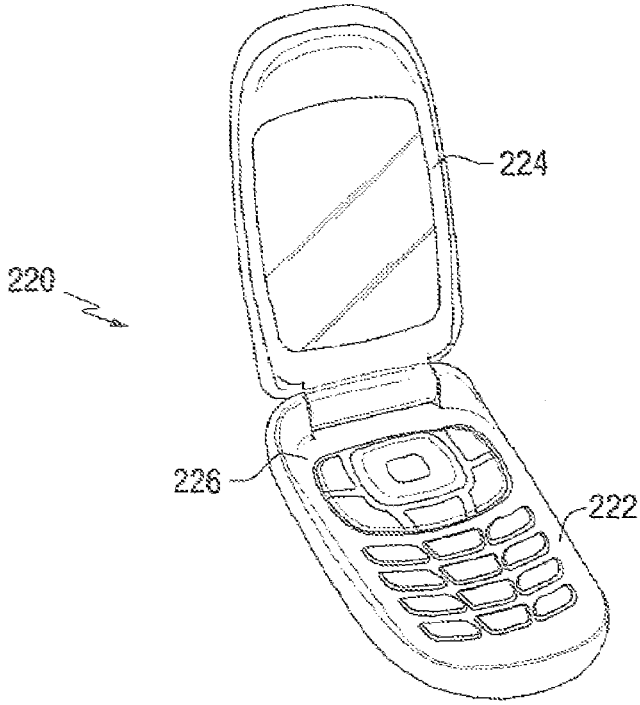
FIG. 21 PRIOR ART
FIG. 21 illustrates a communications device operative with an antenna constructed according to the teachings of the present invention.

The antenna embodiments of the present are operative with various communications devices, especially hand held communications devices such as a folding-type handset 220 of FIG. 21, comprising a housing further comprising a base 222 and a folder 224, with an antenna (e.g., the antenna 118) disposed in the base 222. In one embodiment, the antenna is located generally in a region indicated by a reference character 226. The handset 220 comprises various transmitting and receiving components (transceiver) for sending and receiving wireless communications signals.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof. For example, different sized and shaped elements can be employed to form an antenna according to the teachings of the present invention. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a substrate having first and second substantially parallel conductive surfaces separated by a dielectric;

a first radiating element formed from the first conductive surface of the substrate;

a first ground plane formed from the first conductive surface and spaced apart from the first radiating element;

a second radiating element formed from the second conductive surface of the substrate;

a second ground plane formed from the second conductive surface and spaced apart from the second radiating element;

wherein the first and second radiating elements have substantially the same geometric shape, are aligned and are electrically connected, and wherein the first and second ground planes have substantially the same geometric shape, are aligned and are electrically connected;

a feed terminal in electrical communication with the first radiating element; and a first capacitor connected between a first edge region of the first radiating element and a first edge region of the first ground plane, and an inductor connected in series with the feed terminal.

2. The antenna of claim 1 wherein the first capacitor comprises a dynamically adjustable capacitor for adjusting the antenna performance operating characteristics during operation of the antenna.

3. The antenna of claim 1 wherein a shape of the first and second radiating elements are each defined by first and second substantially parallel sides and a third side intersecting each of the first and the second sides in a substantially perpendicular angle at a first endpoint of each of the first and second sides, wherein the second side is longer than the first side, and wherein the first and second radiating elements further comprise a fourth side extending from a second endpoint of the second side and substantially parallel to and longer than the third side, a fifth side connected to an endpoint of the fourth side and forming an obtuse angle with the fourth side and a sixth side connected between an endpoint of the fifth side and an endpoint of the first side, and wherein the first edge region of the first radiating element comprising a region proximate the fourth side and the feed terminal comprises a region proximate the fifth side.

4. The antenna of claim 1 further comprising a second capacitor connected between a second edge region of the first radiating element and a second edge region of the first ground plane.

5. The antenna of claim 1 exhibiting operating characteristics responsive to a value of the first capacitor and the inductor.

6. The antenna of claim 1 wherein the spaced apart distance is selected to impart desired operating characteristics to the antenna.

7. The antenna of claim 1 wherein the first and the second radiating elements each comprise a generally triangular region extending from a corner region of a generally rectangular region.

8. The antenna of claim 1 wherein the substrate comprises a printed circuit board.

9. The antenna of claim 1 wherein the antenna is tuned for operation in one of more of a 2.4 GHz frequency band, a 4.9 GHz frequency band, a 5.25 GHz frequency band and a 5.85 GHz frequency band in response to a value of the first capacitor and the inductor.

10. A communications device, comprising:

a transceiver for sending and receiving wireless communications signals;

a printed circuit board having a first and second substantially parallel conductive surfaces separated by a dielectric;

an antenna disposed on the printed circuit board and operative with the transceiver, the antenna further comprising:

a first radiating element formed from the first conductive surface and disposed proximate a corner region of the first surface;

a first ground plane formed from the first conductive surface and spaced apart from the first radiating element;

a second radiating element formed from the second conductive surface and disposed proximate a corner region of the second surface;

a second ground plane formed from the second conductive surface and spaced apart from the second radiating element;

a feed terminal electrically connected to the first radiating element; and a first capacitor connected between a first edge region of the first radiating element and a first edge region of the first ground plane, and an inductor connected in series with the feed terminal.

11. The communications device of claim 10 wherein the first capacitor comprises a dynamically adjustable capacitor for adjusting the antenna performance operating characteristics during operation of the communications device.

12. The communications device of claim 10 further comprising a second capacitor connected between a second edge region of the first radiating element and a second edge region of the first ground plane.

13. The communications device of claim 10 wherein the antenna is tuned for operation in one of more of a 2.4 GHz frequency band, a 4.9 GHz frequency band, a 5.25 GHz frequency band and a 5.85 GHz frequency band.

14. The communications device of claim 10 exhibiting operating characteristics responsive to a value of the first capacitor.

* * * * *